United States Patent [19]

Fallon

[11] Patent Number: 4,520,953

[45] Date of Patent: Jun. 4, 1985

[54] SAFETY APPARATUS FOR HIGH PRESSURE SYSTEMS

[75] Inventor: Merton R. Fallon, Thousand Oaks, Calif.

[73] Assignee: Draft Systems, Inc., Northridge, Calif.

[21] Appl. No.: 464,593

[22] Filed: Feb. 7, 1983

[51] Int. Cl.[3] ..... B67D 1/04

[52] U.S. Cl. ..... 222/396; 222/397; 222/399

[58] Field of Search ..... 222/1, 3–4, 222/55, 61, 396–397, 399, 400.7, 401; 137/71, 505.12

[56] References Cited

U.S. PATENT DOCUMENTS

| | | | |
|---|---|---|---|
| 3,129,730 | 4/1964 | Simon | 222/159 X |
| 4,219,040 | 8/1980 | Fallon et al. | 222/396 X |
| 4,305,527 | 12/1981 | McMillin et al. | 222/399 X |

FOREIGN PATENT DOCUMENTS

| | | | |
|---|---|---|---|
| 2220160 | 11/1972 | Fed. Rep. of Germany | 222/399 |

*Primary Examiner*—Charles A. Marmor

*Attorney, Agent, or Firm*—James E. Brunton

[57] ABSTRACT

A safety apparatus and method of using same in dispensing beverages, such as soft drinks and beer, in which the beverage is dispensed by introducing gases under pressure into the beverage container to force the beverage to flow from the container through a dispensing outlet, or faucet. The apparatus comprises a pair of redundant pressure reducing regulators, a frangible burst disc and one or more flow control check valves all interconnected in a predetermined sequence. The apparatus is installed between the high pressure gas source and the beverage container. In accordance with the method of the invention the various components are adjusted at particular pressure settings depending upon the beverage to be dispensed.

6 Claims, 2 Drawing Figures

SAFETY APPARATUS FOR HIGH PRESSURE SYSTEMS

BACKGROUND OF THE INVENTION

1. Field of the Invention

The present invention relates to pressure regulation apparatus and more particularly concerns a novel safety apparatus for use in beverage dispensing applications wherein a source of high pressure gas is interconnected with a container containing the beverage to be dispensed, such as beer or soft drinks, and gases under pressure are introduced into the container to cause the dispensing of the beverage through a fluid outlet from the container.

2. Background of the Invention

Typically, dispensing systems for carbonated beverages use carbon dioxide gas as a pressurization media for dispensing the beverage. This is done for a variety of reasons. First of all, the system requires some sort of gas pressure applied to the reservoir of beverage in order to "push" the beverage out through the container outlet, or dispensing faucet. In addition, since the beverages are already carbonated, the carbonation level, and accordingly, the quality of the product, is maintained by keeping a fixed level of carbon dioxide gas pressure applied to the free surface of the light beverage.

Generally the carbon dioxide used as the dispensing medium is pressurized to its "critical pressure" at which point it becomes liquid and can be stored in that state with great density inside a heavy-walled, high-pressure, gas cylinder. Nearly all industrial gases are stored in heavy-walled pressure cylinders and generally are transported and dispensed without catastrophic incident. This is because in most industrial uses the gasses are dispensed through various types of flow and pressure regulators to atmosphere for welding, breathing, or whatever. However, in the case of beverage dispensing, the gases are dispensed into another pressure vessel which, if over-pressurized, becomes explosive and can do great damage and can cause serious injury and even death.

In the past, in order to avoid over-pressurization in the normal operation of beverage dispensing systems, a pressure reducing regulator is installed on the $CO_2$ gas cylinder or bottle to reduce the pressure from its nominal level of, say, 1000 pounds per square inch (psi), to the dispensing pressure required for the particular beverage. In beer, for example, the dispensing pressure is normally about 15 pounds per square inch gauge (psig). It has been normal practice to install a single pressure reducing regulator at the bottle and then transport the gas at the reduced pressure to the containers or kegs containing the liquid through plastic hoses having a wall thickness of about $\frac{1}{8}$ inch. The pressurization limit of such hose is variable and may range from about 450 psi instantaneous gauge pressure down to some 60 or 80 psi continuously applied pressure over a time span of 20 or 30 minutes. In short, the pressure retention capacity of the plastic hose, or of any other plastic material, is time-dependent. Unfortunately, the metal pressure vessel containing the beverage to be dispensed has a specific yield point that is instantaneously effective and causes the container to catastrophically rupture at a lower instantaneously applied pressure than the hose itself. The net result is that the failure of the pressure regulator can cause the pressure vessel, or beverage container, to explosively rupture and cause great damage. Unfortunately, catastrophic over-pressurization frequently occurs at the time of connection of the source of gas when someone is standing nearby and, therefore, frequently results in death or dismemberment.

A standard commercially available pressure reducing regulator which has been attached to a high pressure source of liquified gas, like any other mechanical device, is going to fail at some point in time. It is not so much a question of whether the device will fail, but rather when and how it will fail. The regulator can, of course, fail in the closed position, meaning that no gas can be transported through the device to, or toward, the pressure vessel or beverage container. That mode of failure, unfortunately, is very infrequent. The more frequent mode of failure is the over-pressurization failure, which is the catastrophically dangerous mode of failure. The high pressure, or over pressure failure mode can be characterized as a "creeping" failure or an "instantaneous" high-pressure failure. Either mode of high-pressure failure can cause the beverage vessel to rupture explosively.

In light of the failure propensity of commercial regulators, manufacturers of the regulators have recommended the installation of "relief valves" somewhere downstream in the system. Further, in various attempts at avoiding liability and "achieving safety", various organizations "require" the installation of the relief valve in the coupling device in order that it is always present in the system. However, the existence of the "safety relief valve" at such a location is absolutely a waste of time. In the first place, there is no way to functionally test the device to see whether or not it is working, that is, to see whether or not it lifts at the prescribed pressure. Secondly, it can be, and frequently is, contaminated by product exposure and has glued itself shut. Third, because of its location (integral with the tapping device) it is too small in size to expel the gas from the system at the same rate that it is flowing into the system. Accordingly, the pressure continues to build inside the pressure vessel without regard for the presence of the device. Fourth, because of the nature of the $CO_2$ gas, and its propensity for freezing, the relief device, if it actuates at all, will promptly freeze the escape port closed in a few seconds. When this occurs, the continued discharge of the gas and the pressure inside the pressure vessel will soon build to an equilibrium level with the pressure inside the bottle. It requires no detailed analysis to conclude that when using liquified gas storage one always has pressures in the range of 800 psi to 1800 psi, or higher, at the pressure source. For the reasons previously discussed it must be concluded that there is only one element in the typical prior art system which can cause, or allow, an over-pressurization circumstance and that item is the Pressure Reducing Regulator. A failure of the Pressure Reducing Regulator, whether induced or accidental, can allow the high pressure which is always available at the source to feed through into the system. Every beer keg or pressure vessel that has ever been manufactured can be explosively ruptured if exposed to the maximum pressure available in the normally used high pressure gas sources. Accordingly, since commercial pressure reducing regulators will fail as a function of time, the prior art dispensing systems comprise fused "time bombs" just waiting to go off.

As will become apparent from the discussion which follows, the method and apparatus of the present invention overcomes the drawbacks of the prior art and, for the first time, provides an absolutely safe apparatus for use in the dispensing of beverages in systems using high pressure gas sources.

Basically the apparatus of the invention precludes catastrophic failure by providing two redundant regulators in series installation and, at the same time, providing means for continuously monitoring the system in a manner which will give a positive indication of the failure of one of the regulators. As a back-up to the redundant regulators, a frangible burst disc is strategically placed within the system to positively preclude over-pressurization of the system. Further, the unique method and apparatus of the invention insures that if one regulator should fail the system must be shut down for corrective action. Finally, since one of the major causes of regulator failure is contamination with dried beverage product, the system also includes means to positively preclude the exposure of the redundant regulator devices to the beverage product.

SUMMARY OF THE INVENTION

It is an object of the present invention to provide a safety apparatus for use in beverage dispensing applications in which over-pressurization of the beverage container to a point of catastrophic failure is precluded through the use of redundant pressure reducing regulators coupled with means for automatically venting the system to atmosphere in the event all elements of the system fail and the system is inadvertently exposed to dangerously high pressures.

It is another object of the invention to provide a safety apparatus of the aforementioned character which provides means for continuously monitoring the system to positively determine the failure of one of the redundant regulators.

It is another object of the invention to provide a safety apparatus of the type described in the preceding paragraphs which ensures that if one regulator is detected as having failed, the system must be shut down for appropriate corrective action.

It is a further object of the invention to provide a safety apparatus of the character described in which contamination of the redundant regulators by the beverage being dispensed is positively precluded.

It is another object of the invention to provide a safety apparatus of the class described which is fully compatible with existing beverage dispensing systems and one which can be easily and inexpensively installed.

It is still another object of the invention to provide a safety apparatus as described in the previous paragraphs which is highly reliable in use, is easy and inexpensive to maintain and is one which can be inexpensively manufactured in large volume.

DESCRIPTION OF ONE FORM OF THE INVENTION

Figure 1:
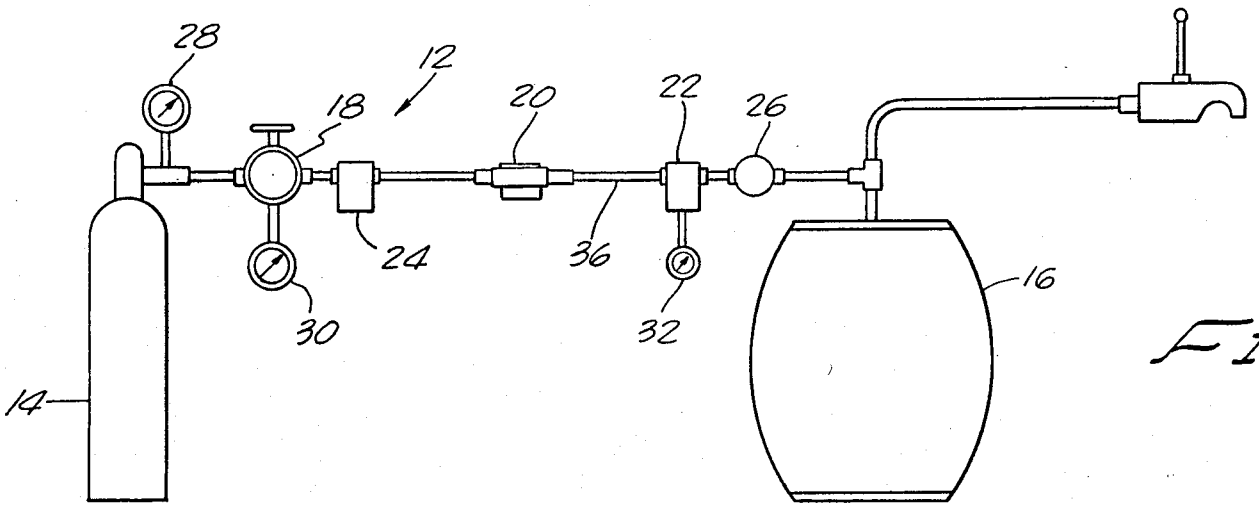
FIG. 1 is a generally schematic view of the safety apparatus of the present invention shown interconnected between a source of high pressure gas and a container containing the beverage to be dispensed.
Figure 2:
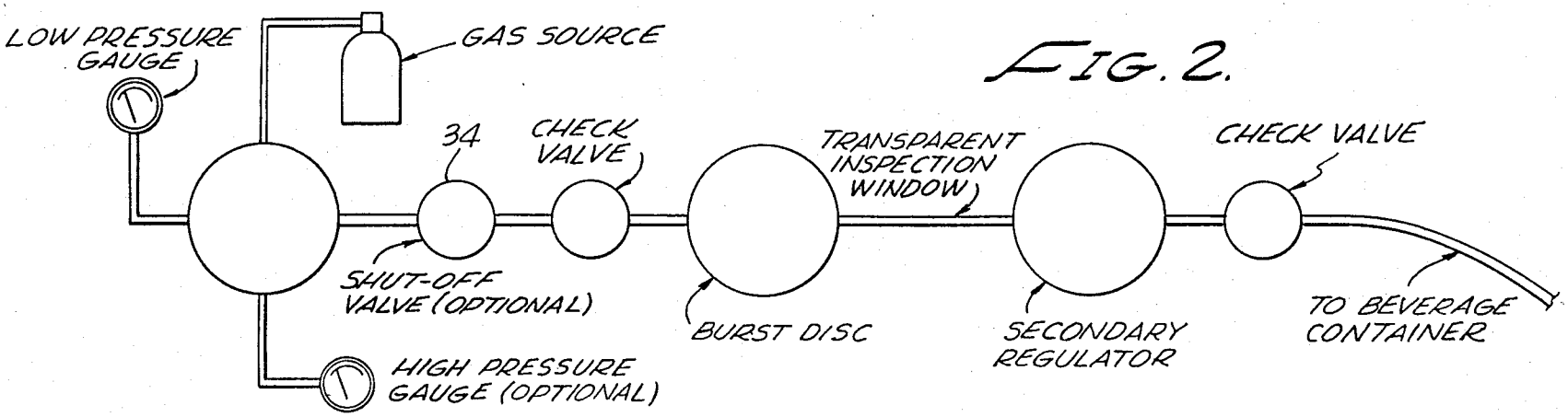
FIG. 2 is a diagrammatic view, similar to FIG. 1, showing the relative positioning of the various elements of the safety apparatus of the invention.

Referring to FIGS. 1 and 2 of the drawings, the safety apparatus of the present invention is generally designated by the numeral 12. The basic components of the apparatus of the form of the invention shown in the drawings comprise first and second regulator means, first and second flow control means and a vent means for venting the source gases flowing through the system to atmosphere when a predetermined pressure is reached. Each of the components is interconnected by conduit, such as tubing, in a particular sequence presently to be described. In the drawings, the source of gas under pressure which may, for example, be liquified carbon dioxide ($CO_2$), is designated by the numeral 14. The container housing the beverage to be dispensed is depicted in FIG. 1 as a keg and is designated by the numeral 16. The first regulator means is provided in the form of a primary pressure reducing regulator 18 which is interconnected between the container 16 and the source of high pressure gas 14. The primary regulator is capable of adjustment so as to permit the continuous flow of gas toward the container at first pressure which pressure is higher than the pressure desired for the normal dispensing of the beverage contained within container 16.

Disposed intermediate the container and the first pressure reducing regulator 18 is the vent means, provided here in the form of a frangible burst disc 20. Burst disc 20 is adapted to fail and to automatically vent the source gas flowing therethrough to atmosphere at a pressure substantially less than the burst pressure of the container 16.

A second regulator means, shown here in the form of a secondary pressure reducing regulator 22, is disposed between the container 16 and the frangible burst disc 20. This secondary pressure reducing regulator is of similar construction to regulator 18, and is capable of adjustment to permit continuous flow of gas toward the container of a second, lower pressure than the pressure of the gas flowing from the primary regulator 18 through the frangible burst disc and toward the secondary regulator 22. The purpose of maintaining the pressure output from the secondary regulator at a lower value will presently be discussed.

Interposed between primary regulator and the frangible burst disc 20 is a first flow control means, provided here in the form of a check valve 24. Check valve 24 is adapted to permit the flow of gas from the primary regulator in a direction toward the burst disc 20, but is adapted to restrict all fluid flow in the opposite direction, that is, in a direction toward the source gas 14. For reasons presently to be described, check valve 24 is designed so that it will not permit forward flow of gas therethrough until a predetermined "cracking" pressure is reached. A second fluid flow control means, provided in the form of a second check valve 26, is disposed between the container 16 and the secondary pressure reducing regulator 22. Check valve 26 is also adapted to permit the flow of gas in a direction toward the container 16, but is adapted to restrict all fluid flow in the opposite direction. The primary function of the second check valve 26 is to preclude any reverse flow of fluids from the beverage container toward the source gas and thereby to prevent the undesirable contamination of the regulators and the burst disc.

Additional elements of the apparatus of the invention as shown in the drawings consists of a high pressure gage 28, which may be interconnected with the gas cylinder, or source of gas 14. Also provided is a low pressure gage 30, which can be interconnected with, or made a part of, the primary regulator 18. A second low pressure gage 32 can be provided, if necessary, in connection with the secondary gas reducing regulator 22. Also, as shown in FIG. 2, for certain applications, a shut off valve 34 may be provided between the primary regulator 18 and the first check valve 24.

An important aspect of the safety apparatus of the present form of the invention is visual inspection means, provided here in the form of a length of transparent plastic hose interconnecting the first burst disc 20 and the secondary regulator 22. This transparent inspection view section, or length of plastic hose 36, provides for constant visual inspection to determine whether contaminents have accidentally reached and passed upstream of the secondary regulator 22. The presence of such contaminants would indicate contamination of the secondary regulator and should trigger immediate corrective action by the operator. For certain applicaions, inspection means in the form of transparent plastic hose may also be used to interconnect the check valve 26 with the container 16 and to interconnect the secondary regulator 22 with the check valve 26. The use of such inspection means permits continuous checking for possible detrimental back flow of the beverage product in a direction toward the gas source.

The apparatus of the invention may be used in connection with a wide variety of beverages including soft drinks, beer, wine and the like. By way of example, when the safety apparatus of the invention is used in connection with the dispensing of beer, a frangible burst disc 20 will be selected so that it will rupture at a pressure of about 80 psi, which is well below the burst pressure of the beer keg. Accordingly, the burst disc will act as a back up device in the event all other elements fail to positively preclude overpressurization of the system. The construction of the burst disc is such that upon failure all of the $CO_2$ gas from a standard $CO_2$ gas bottle flowing at maximum flow rate conditions will be effectively discharged to atmosphere without danger of the outlet of the burst disc plugging, freezing, blocking, or otherwise impeding the free flow of the gas to atmosphere.

It is to be noted that, unlike the pressure relief valves used in prior art systems, the burst disc of the present invention is fail-safe and can only fail at a pressure below design level and never at pressures above the design level. It can readily be constructed of materials which are impervious to deterioration of performance by contamination from the beverage being dispensed and it can be strategiclly placed in the system so that it can not be blocked by adjacent articles.

A unique and highly important feature of the system of the present invention is the method by which temporary "fixes" of the system are precluded in the event of a discovered failure of one of the pressure reducing regulators. In the dispensing of the beer, for example, it is known that if the gas pressure flowing toward the beer keg, or container 16, is increased from the normal 15 psi to a pressure of on the order of 30 to 35 psi, the beer will become "wild". That is it will over carbonate and its appearance as it flows from the faucet, or outlet, 40 (FIG. 1) will be very white in color and it will become unacceptably foamy. With this in mind, if the secondary regulator 22 is set at the 15 psi gage optimum pressure for dispensing of beer, and the primary regulator 18 is set at a pressure of approximately 30 to 35 psi gage, we have now provided a built-in mechanism to force continuous monitoring of the system. For example, if the secondary regulator 22 fails in an open condition allowing the higher gas pressure to flow from the primary regulator 18 through the second regulator and on into the container 16, the beer will become wild and the bartender will no longer be able to dispense it. Accordingly, the bartender is forced to shut down the system and to institute corrective action in order to continue to operate. However, the experienced bartender knows that if he turns down the pressure at the primary regulator to 15 psi gage, he can restore the system to operation and he can then go back to dispensing beer without replacing the defective secondary regulator. This type of quick "fix" is highly undesirable and must be prevented. Therefore, as previously mentioned, check valve 24 is selected so that it will have a cracking, or opening, pressure of a minimum of about 10 to 15 psi pressure differential between its inlet and outlet. With this arrangement, the bartender is forced to set the primary regulator 18 at a pressure differential of at least 10 to 15 psi above the desired pressure he wishes to apply to the beer keg. This being the case, since in the present example the secondary regulator has failed in the open position, the bartender cannot correct the wild beer problem by simply adjusting the primary regulator to the desired 15 psi. He must, of necessary, replace the failed secondary regulator before he can continue to dispense beer. Thusly, the "quick fix" option is taken from him.

To provide even greater protection against a undesirable "quick fix" solution, in certain applications the check valve 24 may be installed internally of the burst disc device and in this way can be maintained hidden from view. With this construction, the bartender cannot see the check valve, is not aware that it is there, does not know its purpose, and cannot, without special tools, adjust the device. Accordingly, he is required to maintain the primary regulator pressure at least within the 30 to 35 psi gage range in order to "crack" the check valve and operate the system at all. Therefore, to dispense the beer the secondary regulator must be replaced and properly set at the 15 psi setting.

It is apparent that other pressure settings for the check valve and the regulators can be appropriately selected for the dispensing of other beverages. Similarly, the burst disc can be adapted to fail at higher or lower pressures depending upon the burst pressure of the particular beverage container. With the installation and proper setting of the components of the apparatus as heretofore described, the particular beverage dispensing system can be rendered absolute fail-safe. For example, if the secondary regulator fails in the open position, corrective action must be taken in the manner previously described. On the other hand, if either the primary or secondary regulator fails in its closed position, gases cannot flow toward the beverage container and the system is automatically shut down until corrective or restorative action is taken. If the primary regulator fails in an open condition, while the secondary regulator continues to operate normally, the gas pressure within the beverage container, or pressure vessel, will be automatically maintained at the level controlled by the secondary regulator. Accordingly, the higher gas pressure which is allowed into the system due to the failure of the primary regulator can only persist as far as the secondary regulator inlet. Additionally, if the primary regulator pressure should build, whether slowly or rapidly, to the burst disc failure pressure (for example 80 psi), the burst disc will instantly, and automatically, rupture venting the gas safely to atmosphere. Obviously, once the burst disc has ruptured, the gas will escape to atmosphere until either the valve at the pressure source is closed or the pressure source is depleted its supply of gas. The burst disc, by its very nature, is fail-safe and the prospects or probability of its failing are virtually nil, whether it has been contaminated with the beverage or not.

In summary, a failure mode analysis of the apparatus of the invention clearly establishes that, so long as the apparatus remains unaltered, unsafe pressure levels cannot be attained in the beverage containers and a catastrophic failure cannot occur.

With the apparatus of the invention installed between the pressure vessel 14 and the beverage container 16 in the manner shown in the drawings, the method of the invention comprises the steps of properly adjusting the pressure settings on the various components of the system. For example, in dispensing a beverage such as beer the first step of the method is to set the primary regulator at a pressure of about 30 to 35 psi. At this pressure, the beer flowing from the beverage container will be foamy and "wild", making dispensing thereof impossible. The next step, therefore, will be to set the secondary regulator at a pressure of about 15 psi, which is the optimum pressure for dispensing the beer. Next, to preclude a quick "fix" solution should the secondary regulator fail, the cracking pressure of the first check valve is set at a pressure which requires an input pressure of about 30 to 35 psi in order for the gas to flow through the check valve. Finally the burst disc failure pressure is set at about 80 psi, which is well below the burst pressure of the beer keg.

Similar settings can be selected for the dispensing of other beverages and the steps of the method will comprise setting the various components of the system to the prescribed settings. For example, the primary regulator will always be set at a pressure higher than that acceptable for the dispensing of the particular beverage. The secondary regulator will then be set to the optimum dispensing pressure. The first check valve setting will be such as to only accomodate flow at a pressure of the setting of the primary regulator. Finally, the burst disc will be set at a failure pressure of substantially below the burst pressure of the particular beverage container.

Having now described the invention in detail in accordance with the requirements of the patent statutes, those skilled in this art will have no difficulty to making changes and modifications in the individual parts or their relative assembly in order to meet specific requirements or conditions. Such changes and modifications may be made without departing from the scope and spirit of the invention, as set forth in the following claims.

I claim:

1. A safety apparatus for use in beer dispensing applications wherein a source of high pressure gas is interconnected with a container containing the beer to be dispensed, said apparatus comprising:

(a) a primary pressure reducing regulator interconnected between the container and the source of high pressure gas and proximate the latter, said primary regulator being capable of adjustment to permit the continuous flow of gas toward the container at a pressure of about 35 psi;

(b) a frangible burst disc interconnected between the container and said primary regulator, said burst disc being adapted to fail and to automatically vent source gas flowing therethrough to atmosphere at a pressure of about 80 psi;

(c) a secondary pressure reducing regulator interconnected between the container and said burst disc and proximate the latter, said secondary regulator being capable of adjustment to permit the continuous flow of gas toward the container at a pressure of about 15 psi;

(d) a check valve interconnected between the container and said secondary regulator, said second check valve being adapted to permit the flow of gas toward the container, but to restrict all fluid flow in the opposite direction; and (e) a check valve interconnected between the container and said primary regulator to permit the flow of gas toward the container, but to restrict gas flow in the opposite direction, said check valve being adapted to restrict gas flow toward said secondary regulator until the input pressure to said check valve reaches about 35 psi.

2. A safety apparatus as defined in claim 1 including visual inspection means disposed intermediate said frangible burst disc and said secondary pressure reducing regulator for permitting visual detection of contaminates flowing therebetween.

3. A safety apparatus as defined in claim 2 in which said visual inspection means comprises a length of transparent conduit interconnecting said frangible burst disc and said secondary pressure reducing regulator.

4. A safety apparatus for use in beverage dispensing applications wherein a source of high pressure gas is interconnected with a container containing the beverage to be dispensed, and gases under pressure are introduced into the container to cause the dispensing of the beverage through a fluid outlet from the container, said apparatus comprising:

(a) a primary pressure reducing regulator interconnected between the container and the source of high pressure gas and proximate the latter, said primary regulator being capable of adjustment to permit the continuous flow of gas toward the container at a pressure higher than desired for normal dispensing of the beverage;

(b) a vent means interconnected between the container and said primary regulator, for automatically venting source gas flowing therethrough to atmosphere at a pressure substantially less than the burst pressure of the container;

(c) a secondary pressure reducing regulator interconnected between the container and said vent means and proximate the latter, said secondary regulator being capable of adjustment to permit the continuous flow of gas toward the container at a pressure lower than the pressure of the gas flowing from said primary pressure reducing regulator;

(d) a check valve interconnected between the container and said secondary regulator, said check valve being adapted to permit the flow of gas toward the container, but to restrict all fluid flow in the opposite direction; and (e) an additional check valve interconnected between the container and said primary regulator to permit the flow of gas toward the container, but to restrict gas flow in the opposite direction, said additional check valve being adapted to restrict gas flow toward said secondary regulator until the input pressure to said check valve reaches a pressure higher than desired for normal dispensing of the beverage.

5. A safety apparatus as defined in claim 4 which is adapted for use in dispensing beer and in which said primary pressure reducing regulator is adjusted to maintain the flow of gases toward the container at a pressure of between about 30 psi and about 35 psi and in which said additional check valve is adapted to restrict gas flow toward said secondary regulator until the output pressure to said check valve reaches about 35 psi.

6. A safety pressure apparatus as defined in claim 4 in which said vent means comprises a frangible burst disc adapted to automatically vent the gases flowing toward the container to atmosphere when said gases reach a pressure of between about 70 psi and about 90 psi.

* * * * *